US009675185B2

(12) United States Patent
Anderson et al.

(10) Patent No.: US 9,675,185 B2
(45) Date of Patent: Jun. 13, 2017

(54) REFRIGERATED MERCHANDISER WITH SHELF AIR DISCHARGE

(75) Inventors: Timothy D. Anderson, St. Louis, MO (US); Ken Nguyen, St. Louis, MO (US)

(73) Assignee: Hussmann Corporation, Bridgeton, MO (US)

( * ) Notice: Subject to any disclaimer, the term of this patent is extended or adjusted under 35 U.S.C. 154(b) by 579 days.

(21) Appl. No.: 13/092,235

(22) Filed: Apr. 22, 2011

(65) Prior Publication Data

US 2011/0259031 A1 Oct. 27, 2011

Related U.S. Application Data

(60) Provisional application No. 61/327,464, filed on Apr. 23, 2010.

(51) Int. Cl.
*A47F 3/04* (2006.01)

(52) U.S. Cl.
CPC ..... *A47F 3/0447* (2013.01); *A47F 3/0408* (2013.01); *A47F 3/0413* (2013.01); *A47F 3/0443* (2013.01); *F25B 2400/22* (2013.01); *F25D 2317/0665* (2013.01); *F25D 2323/00275* (2013.01)

(58) Field of Classification Search
CPC .... A47F 3/0408; A47F 3/0413; A47F 3/0443; A47F 3/0447; F25B 2400/22; F25D 2317/0665; F25D 2323/00275
USPC ..... 62/255–256, 407, 411, 426
See application file for complete search history.

(56) References Cited

U.S. PATENT DOCUMENTS

| | | | | |
|---|---|---|---|---|
| 3,125,864 | A | 3/1964 | Ural | |
| 3,168,818 | A * | 2/1965 | Weber | 62/256 |
| 3,218,822 | A | 11/1965 | Bently et al. | |
| 3,233,422 | A * | 2/1966 | Kobrin | 62/155 |
| 3,304,736 | A | 2/1967 | Brennan et al. | |
| 3,324,676 | A * | 6/1967 | Gerweck | 62/256 |
| 3,365,908 | A | 1/1968 | MacMaster | |
| 3,369,375 | A * | 2/1968 | Gerweck et al. | 62/256 |
| 3,392,544 | A * | 7/1968 | Perez | 62/256 |
| 3,420,070 | A * | 1/1969 | Hermanson | 62/256 |
| 3,696,630 | A | 10/1972 | Bressickello | |

(Continued)

FOREIGN PATENT DOCUMENTS

| | | |
|---|---|---|
| JP | 6123544 | 5/1994 |
| WO | 02/05689 | 1/2002 |
| WO | 2006/115824 | 11/2006 |

*Primary Examiner* — David Teitelbaum
(74) *Attorney, Agent, or Firm* — Michael Best & Friedrich LLP

(57) ABSTRACT

A merchandiser including a case that has an air inlet and defines a product display area with a customer access opening. The merchandiser also includes a canopy that has a first air outlet and a second air outlet, a first passageway connecting the air inlet with the first air outlet to direct a first airflow through the first air outlet at least partially across the opening to define a primary air curtain, and a second passageway in fluid communication with a HVAC system by ducting coupled between the merchandiser and the HVAC system to direct a second airflow defining a secondary air curtain from the HVAC system through the second air outlet at least partially across the opening. The primary and secondary air curtains cooperate with each other to minimize infiltration of ambient air into the product display area.

22 Claims, 6 Drawing Sheets

(56) References Cited

U.S. PATENT DOCUMENTS

| | | | | |
|---|---|---|---|---|
| 3,827,254 | A | 8/1974 | MacMaster et al. | |
| 4,671,074 | A | 6/1987 | Gostelow et al. | |
| 4,760,708 | A | 8/1988 | Karashima | |
| 5,357,767 | A | 10/1994 | Roberts | |
| 5,720,185 | A | 2/1998 | Lee | |
| 5,722,252 | A | 3/1998 | Kang et al. | |
| 6,519,962 | B1 | 2/2003 | Schuetter | |
| 6,615,593 | B2 * | 9/2003 | Thurman | 62/89 |
| 6,722,149 | B1 | 4/2004 | Saroka et al. | |
| 6,742,344 | B2 | 6/2004 | Vormedal | |
| 6,886,359 | B2 | 5/2005 | Yamazaki et al. | |
| 7,062,932 | B2 | 6/2006 | Downs | |
| 7,137,438 | B2 | 11/2006 | Nomura et al. | |
| 7,162,882 | B2 | 1/2007 | Alahyari et al. | |
| 2004/0069002 | A1 | 4/2004 | Chuang et al. | |
| 2007/0289323 | A1 * | 12/2007 | Swofford et al. | 62/256 |
| 2008/0141690 | A1 | 6/2008 | Behr | |
| 2008/0282719 | A1 * | 11/2008 | Fung | 62/255 |
| 2009/0044553 | A1 | 2/2009 | Tilley | |
| 2009/0064707 | A1 | 3/2009 | Smith et al. | |
| 2009/0255287 | A1 | 10/2009 | Alahyari et al. | |
| 2010/0024446 | A1 | 2/2010 | Rohrer et al. | |

* cited by examiner

REFRIGERATED MERCHANDISER WITH SHELF AIR DISCHARGE

RELATED APPLICATIONS

This patent application claims priority to U.S. Provisional Patent Application Ser. No. 61/327,464 filed Apr. 23, 2010, the entire contents of which are hereby incorporated by reference.

BACKGROUND

The present invention relates to a refrigerated merchandiser including a plurality of air curtains, and more particularly, to a merchandiser including a modular shelf air discharge, a primary air curtain, and a secondary air curtain.

In conventional practice, supermarkets and convenience stores are equipped with refrigerated merchandisers that have open display portions for presenting fresh food or beverages in a product display area to customers while maintaining the fresh food and beverages (i.e., food product) in a refrigerated environment. Typically, refrigerated merchandisers include a curtain of cool, refrigerated air that passes downward across the open face portion of the merchandiser to form a flowing boundary of air between the product display area and the rest of the store. The air curtain is generated by an airflow through a passageway of the refrigerated merchandiser that is cooled by one or more evaporators disposed in the passageway, and that is discharged from an outlet in a canopy of the merchandiser. The air curtain assists in keeping refrigerated air within the product display area to cool the food product and protects the product display area from ambient air in the surrounding store. Warmer ambient conditions surrounding the refrigerated merchandiser increase cooling requirements of the merchandiser and can undesirably increase the temperature of the food product in the product display area.

Most refrigerated display merchandisers use a single, long-throw air curtain to minimize ambient air infiltration into the product display area. Some refrigerated merchandisers use multiple air curtains or doors to limit entrainment of ambient air that can occur in a single air curtain refrigerated merchandiser, and to maintain the product display area at desired temperatures. Refrigerated merchandisers with two or more adjacent air curtains include an outer air curtain that has a slightly higher temperature than the inner air curtain, so as to protect the colder, inner air curtain from the impact of ambient air surrounding the merchandiser. These multiple air curtain refrigerated merchandisers are designed to limit problems of entrainment of ambient air into the colder, inner air curtain. However, such designs are still susceptible to the intrusion of ambient air into the refrigerated air curtain.

SUMMARY

In one construction, the invention provides a refrigerated merchandiser including a case that defines a product display area with a customer access opening and that has an air inlet. The merchandiser also includes a canopy disposed substantially above the product display area, and a shelf coupled to the case within the product display area for supporting food product. The canopy includes a first air outlet and a second air outlet located adjacent the first air outlet, and the first air outlet and the second air outlet are in communication with the product display area. The merchandiser also includes a first passageway that fluidly connects the air inlet with the first air outlet to direct a first airflow through the first air outlet across at least a portion of the customer access opening, and a second passageway that is in fluid communication with a heating, ventilation, and air conditioning ("HVAC") system by ducting coupled between the merchandiser and the HVAC system to direct a second airflow from the HVAC system through the second air outlet across at least a portion of the customer access opening. The first airflow discharged from the first air outlet defines a primary air curtain, and the second airflow discharged from the second air outlet defines a secondary air curtain. The primary and secondary air curtains cooperate with each other to minimize infiltration of ambient air into the product display area.

In another construction, the invention provides a refrigerated merchandiser including a case that defines a product display area with a customer access opening and that has a base with an air inlet. The merchandiser also includes a canopy disposed substantially above the product display area, and a shelf coupled to the case within the product display area. The canopy includes a first air outlet and a second air outlet located adjacent the first air outlet, and the first air outlet and the second air outlet are in communication with the product display area. The merchandiser also includes a first passageway that fluidly connects the air inlet with the first air outlet to direct a first airflow through the first air outlet across at least a portion of the customer access opening, a second passageway that fluidly connects a HVAC system with the second air outlet to direct a second airflow ducted from the HVAC system to the merchandiser through the second air outlet across at least a portion of the customer access opening, a shelf that is coupled to the case within the product display area and including a third air outlet in communication with the product display area, and a third passageway that is in fluid communication with the third air outlet to direct a third airflow through the third air outlet across a portion of the customer access opening. The first airflow discharged from the first air outlet defines a primary long throw air curtain, the second airflow discharged from the second air outlet defines a secondary long throw air curtain, and the third airflow discharged from the third air outlet defines a primary short throw air curtain located inside the primary long throw air curtain. The primary long throw air curtain and the secondary long throw air curtain cooperate with each other to maintain an upper portion of the product display area within a predetermined temperature range. The primary long throw air curtain, the secondary long throw air curtain, and the primary short throw air curtain cooperate with each other to maintain a lower portion of the product display area within the predetermined temperature range.

In another construction, the invention provides a refrigerated merchandiser including a case that defines a product display area with a customer access opening and that has a base with an air inlet. The merchandiser also includes a canopy disposed substantially above the product display area, and a shelf coupled to the case within the product display area for supporting food product. The canopy includes a first air outlet and a second air outlet located adjacent the first air outlet, and the first air outlet and the second air outlet are in communication with the product display area. The merchandiser also includes a first passageway fluidly connecting the air inlet with the first air outlet to direct a first refrigerated airflow through the first air outlet across at least a portion of the customer access opening, and a second passageway fluidly connecting a heating, ventilation, and air conditioning ("HVAC") system with the second air outlet to direct a second airflow through the second air outlet across at least a portion of the customer access opening. The first refrigerated airflow discharged from the first air outlet defines a primary air curtain, and the second airflow discharged from the second air outlet defines a secondary air curtain. The merchandiser further includes a first fan coupled to the case and in fluid communication with the first passageway to generate the first refrigerated airflow, and a second fan located in the HVAC system and in fluid communication with the second passageway to generate the second airflow.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
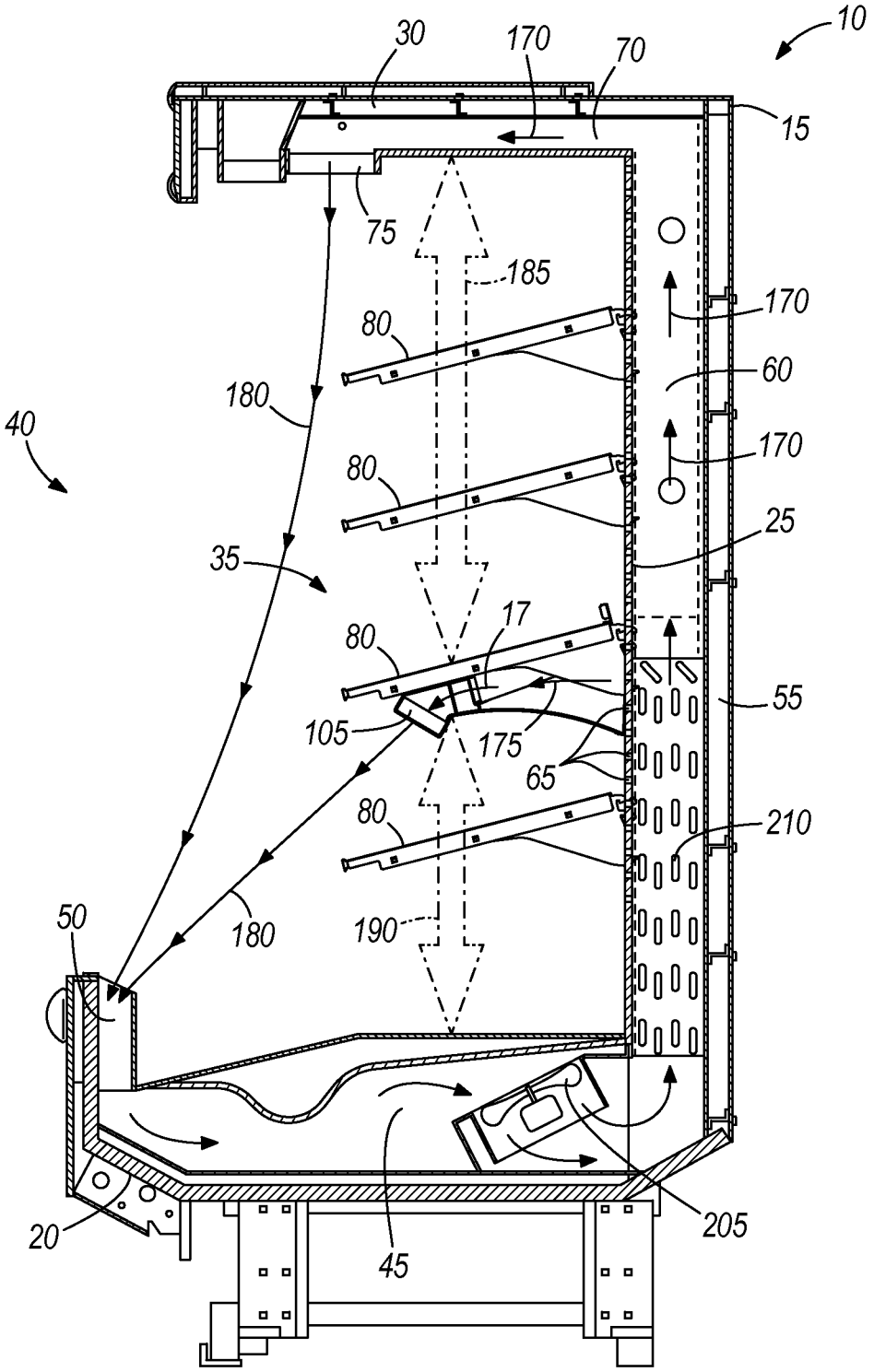
FIG. 1 is a side view of a refrigerated merchandiser embodying the present invention.

FIG. 1 shows one construction of a refrigerated merchandiser 10 that may be located in a supermarket or a convenience store or other retail setting (not shown) for presenting fresh food, beverages, and other food product (not shown) to consumers. The refrigerated merchandiser 10 includes a case 15 having a base 20, a rear wall 25, and a canopy 30. The area partially enclosed by the base 20, the rear wall 25, and the canopy 30 defines a product display area 35 that stores food product in the case 15 and that is accessible by customers through an opening 40 adjacent the front of the case 15. In the illustrated construction, the merchandiser 10 is a self-contained merchandiser with an open front. In other constructions, the merchandiser 10 may include the one or more doors positioned over the opening 40 to provide access to the product display area 35.

The base 20 is disposed substantially below the product display area 35 and can be supported by a floor or support surface (not shown) of the supermarket. The base 20 defines a lower portion of the product display area 35 that can support a portion of the food product in the case 15. The base 20 further defines a lower discharge flue 45 and includes an air inlet 50 located adjacent a lower portion of the opening 40. The lower discharge flue 45 is in fluid communication with the air inlet 50 and conducts air substantially horizontally through the base 20 from the air inlet 50. The air inlet 50 is positioned to receive surrounding air from within and adjacent the product display area 35 in a substantially vertical direction to direct the surrounding air into the lower discharge flue 45.

FIG. 1 shows the rear wall 25 that defines a rear portion of the product display area 35 and that cooperates with an outer wall 55 of the case 15 to define a rear discharge flue 60. In the illustrated construction, the rear wall 25 also includes apertures 65 fluidly coupling the rear discharge flue 60 with the product display area 35 and allowing at least some of the airflow in the rear discharge flue 60 to enter the product display area 35. In other constructions, the rear wall 25 may not include the apertures 65. The rear discharge flue 60 is in fluid communication with the lower discharge flue 45 to direct the airflow in a substantially vertically upward direction.

The canopy 30 is disposed substantially above the product display area 35 and defines an upper portion of the product display area 35 that has an upper discharge flue 70 and a primary outlet 75. The primary outlet 75 is disposed adjacent the product display area 35. The upper discharge flue 70 is in fluid communication with the rear discharge flue 60 and conducts the air substantially horizontally through the canopy 30 toward the primary outlet 75.

The merchandiser 10 also includes shelves 80 disposed within the product display area 35 to support food product. Each shelf 80 is attached to the rear wall 25 at one end, and extends outward from the rear wall 25 toward the front of the case 15. FIGS. 3, 4, 8, and 9 show one shelf 80 including attachment hooks 85 for attaching the shelf 80 to the rear wall 25, a support surface 90 for supporting food product, and a rail 95. The rail 95 is disposed below the support surface 90 and extends partially along the length of the shelf 80 from a middle of the shelf toward the attachment hooks 85. In the illustrated construction, the shelf 80 also includes a light source 100 (e.g., LED light source, fluorescent light source, etc.) positioned on the end of the shelf 80 that is located nearest the opening 40 to illuminate food product in the product display area 35. As illustrated in FIG. 1, the shelves 80 extend generally downward from the rear wall 25 toward the opening 40. In other constructions, the shelves 80 may be horizontal. Generally, the shelves 80 may be oriented at any desired angle to display food product.

As shown in FIGS. 1, 4, 8, and 9, the merchandiser 10 further includes a discharge duct apparatus 105 that is removably coupled to one shelf 80. In the illustrated construction, the discharge duct apparatus 105 is coupled to the shelf 80 that is located between the base 20 and the canopy 30 near a central portion of the product display area 35. In other constructions, the discharge duct apparatus 105 may be coupled to two or more shelves 80. In some constructions, the discharge duct apparatus 105 is a modular apparatus such that can be attached to the shelf 80 before or after the shelf 80 is coupled to the rear wall 25. In other constructions, the discharge duct apparatus can extend the length of the case 15.

As shown in FIGS. 5-9, the discharge duct apparatus 105 includes a track 110 that removably attaches the apparatus 105 to the rail 95 on the underside of the shelf 80. Specifically, the track 110 slides into and out of the rail 95 to facilitate installation and removal of the discharge duct apparatus 105 relative to the case 15 without detaching the shelf 80 from the rear wall 25, and without removing food product from the shelf 80.

With reference to FIGS. 4-7, the discharge duct apparatus 105 also includes a first end 115 that has an air intake portion 120, and a second end 125 that has an air discharge portion 130 in fluid communication with the air intake portion 120 via a discharge passageway 135. The discharge duct apparatus 105 tapers narrower from the first end 115 toward the second end 125 to channel or direct air from the air intake portion 120 to the air discharge portion 130. The tapered shape of the discharge duct apparatus 105 also accommodates space for food product stored on the shelf 80 that is below the discharge duct apparatus 105.

Figure 6:
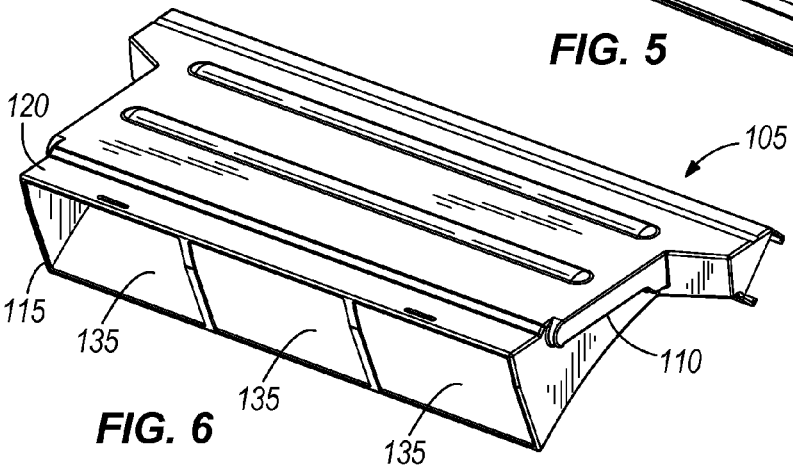
FIG. 6 is another perspective view of the discharge duct apparatus of FIG. 4.
Figure 7:
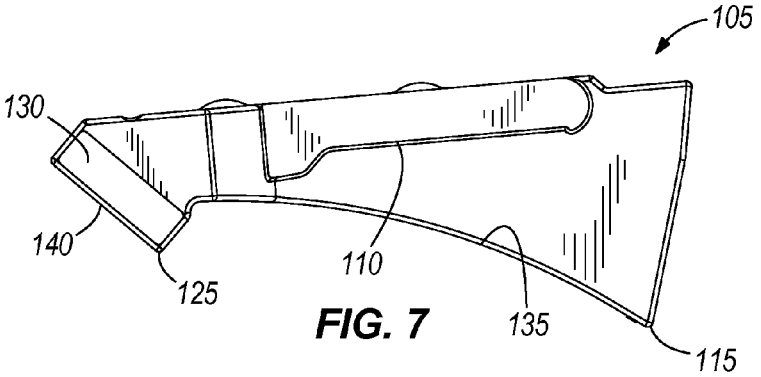
FIG. 7 is a side view of the discharge duct apparatus of FIG. 5.
Figure 8:
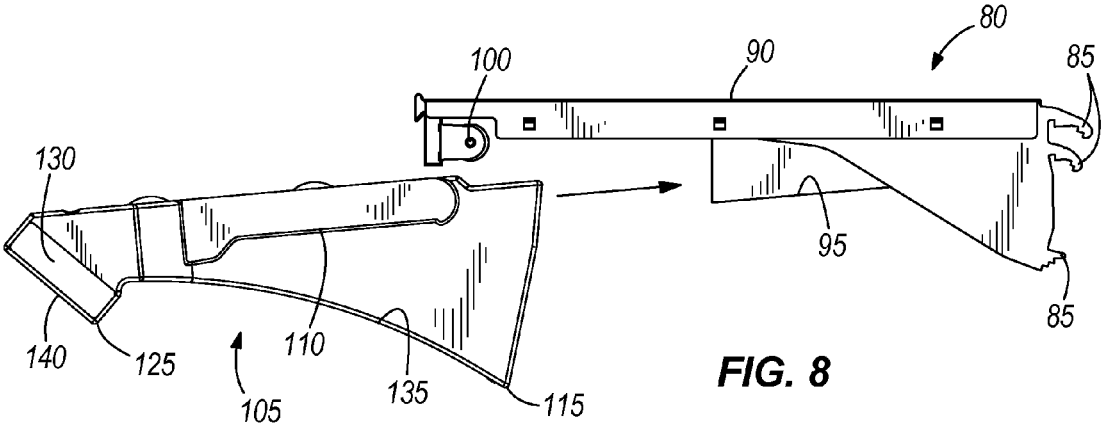
FIG. 8 is a side view of the shelf and the discharge duct apparatus in a pre-assembled state.
Figure 9:
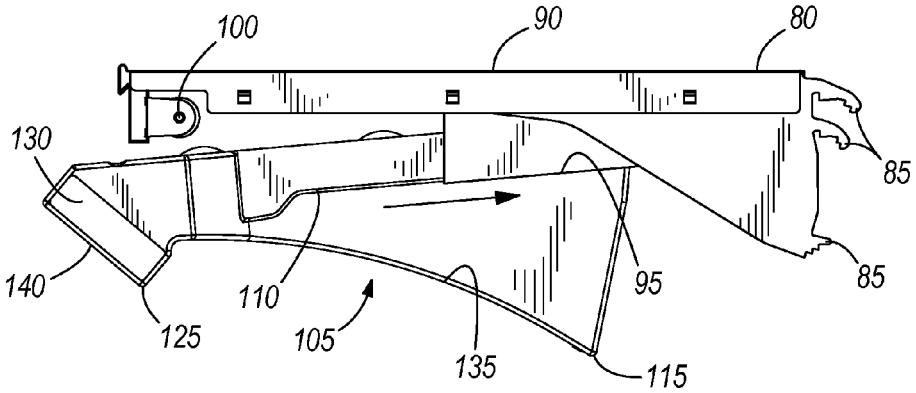
FIG. 9 is a side view of the shelf discharge unit and the shelf during assembly.

The air intake portion 120 is in fluid communication with the rear discharge flue 60 via the apertures 65 or an opening (not shown) in the rear wall 25 to receive air from the rear discharge flue 60. As shown in FIG. 6, the air intake portion 120 includes multiple passageways 135 for directing air into the discharge duct apparatus 105.

The air discharge portion 130 is smaller than the air intake portion 120 and is angled generally downward (as viewed in FIGS. 4 and 7) relative to the portion of the discharge duct apparatus 105 defining the discharge passageway 135. A louver or honeycomb can be positioned across a discharge outlet 140 of the discharge duct apparatus 105 for discharging air from the discharge passageway 135 in a generally uniform manner. In some constructions, the discharge duct apparatus 105 can be integrally formed as part of one or more shelves 80 such that the shelf includes the air intake portion 120, the air discharge portion 130, and the discharge passageway 135.

Figure 2:
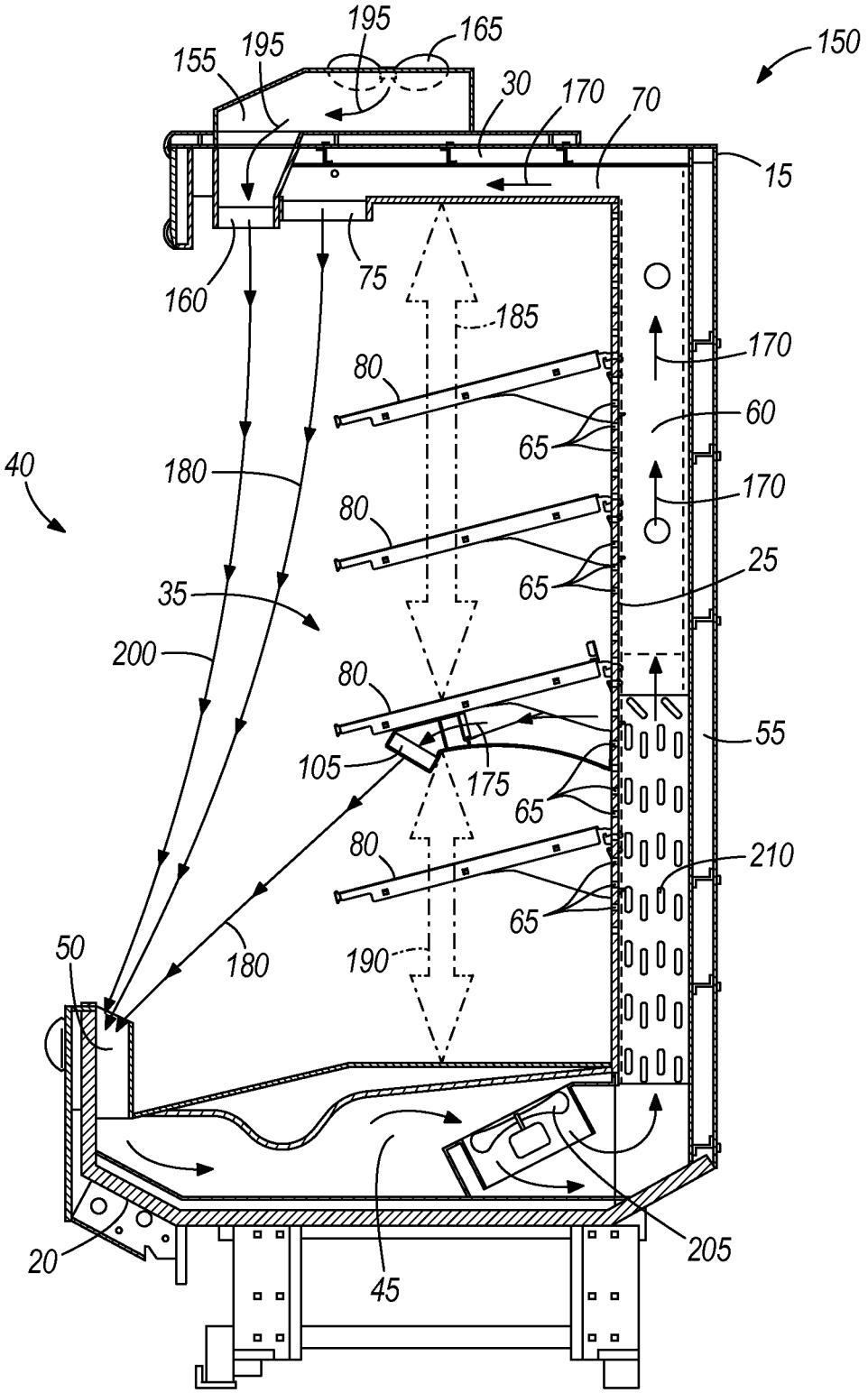
FIG. 2 is a side view of another refrigerated merchandiser embodying the present invention.
Figure 3:
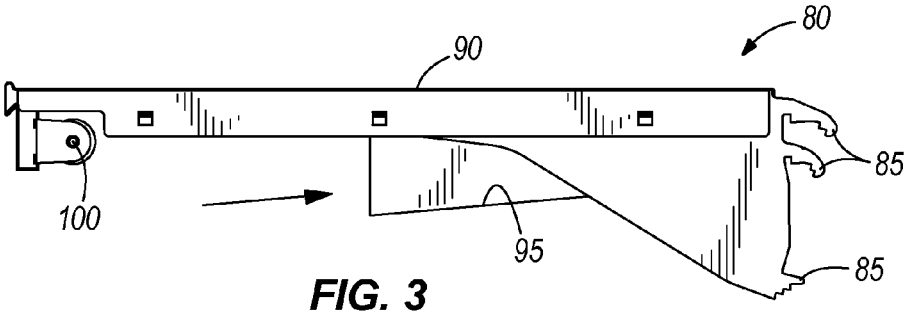
FIG. 3 is a side view of a shelf of the merchandisers of FIGS. 1 and 2.
Figure 4:
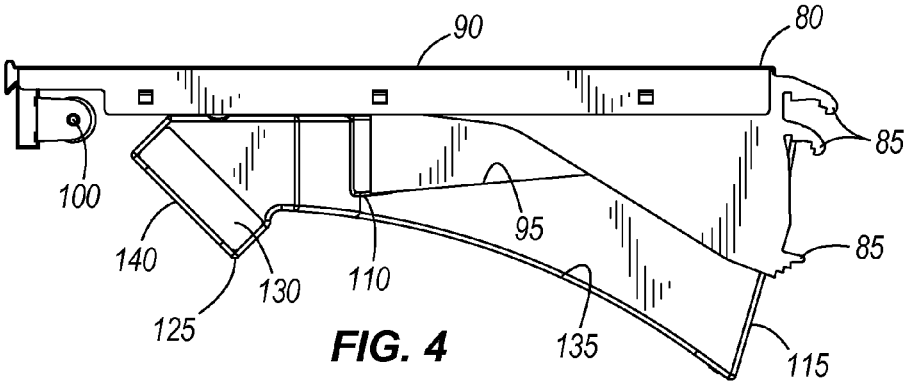
FIG. 4 is a side view of the shelf of FIG. 3 and a discharge duct apparatus coupled to the shelf.
Figure 5:
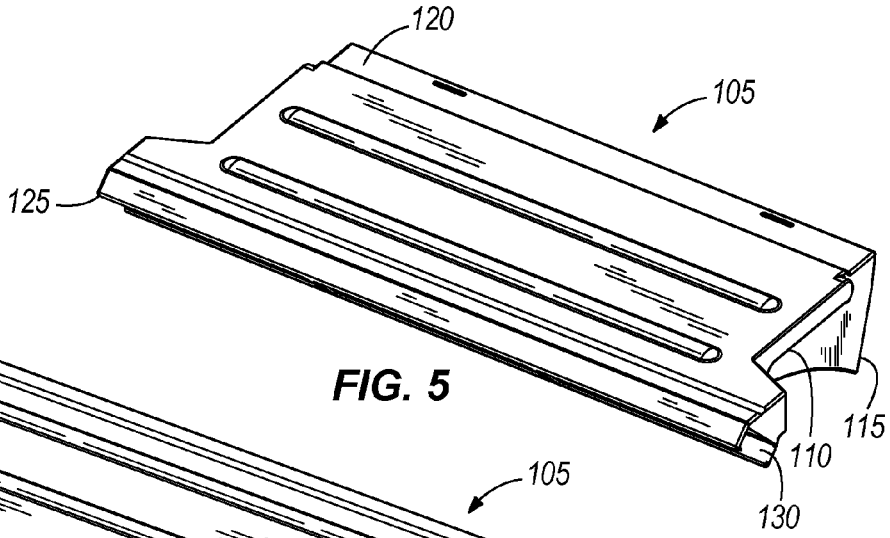
FIG. 5 is a perspective view of the discharge duct apparatus of FIG. 4.

FIG. 2 shows another construction of a refrigerated merchandiser 150 that may be located in a supermarket or a convenience store for presenting fresh food, beverages, and other food product to consumers. Except as described below, the refrigerated merchandiser 150 is the same as the merchandiser 10 described with regard to FIG. 1, and common elements have been given the same reference numerals.

The canopy 30 of the merchandiser 150 has an ambient air passageway 155 and a secondary outlet 160 that is located outward from the primary outlet 75 adjacent an end of the canopy 30. The secondary outlet 160 is in fluid communication with the ambient air passageway 155, and one or more fans 165 are coupled to the canopy 30 and in fluid communication with the ambient air passageway 155 to direct air from outside the case 15 through the canopy 30 toward the secondary outlet 160.

With reference FIGS. 1 and 2, the lower discharge flue 45, the rear discharge flue 60, and the upper discharge flue 70 define a first portion of a primary air passageway that directs a first airflow 170 from the air inlet 50 to the primary outlet 75. The lower discharge flue 45, the rear discharge flue 60, and the discharge duct apparatus 105 define a second portion of the primary air passageway that directs a second airflow 175 from the air inlet 50 to the discharge outlet 140.

The first airflow 170 discharged from the primary outlet 75 and the second airflow 175 discharged from the discharge outlet 140 define primary air curtains 180. The primary air curtain 180 discharged from the primary outlet 75 is defined as a long throw air curtain that travels generally downward from the primary outlet 75 across the opening 40 toward the air inlet 50. Specifically, the primary air curtain 180 discharged from the primary outlet 75 is directed across an upper interior portion 185 and a lower interior portion 190 of the merchandiser 10, 150 to cool the upper and lower interior portions 185, 190 within a desired temperature range. The primary air curtain 180 discharged from the discharge outlet 140 is defined as a short throw or modular air curtain that travels generally downward a relatively short distance from the discharge duct apparatus 105 across the lower interior portion 190 toward the air inlet 50. The primary air curtain via the discharge outlet 140 supports the primary air curtain 180 discharged from the primary outlet 75, and helps direct that primary air curtain 180 toward the air inlet 50. The primary air curtains 180 discharged from the primary outlet 75 and the discharge outlet 140 are dual or sequential air curtains directed across a lower interior portion 190 of the merchandiser 10, 150 that complement each other to maintain a smaller range of product temperatures throughout the case 15.

With reference to the merchandiser 150 illustrated in FIG. 2, the ambient air passageway 155 directs a third airflow 195 from the ambient environment surrounding the case 15 above the merchandiser 150 to the secondary outlet 160. The third airflow 195 discharged from the secondary outlet 160 defines a secondary air curtain 200. The secondary air curtain 200 is defined as a long throw air curtain that travels generally downward from the secondary outlet 160 toward the air inlet 50. The secondary air curtain 200 is located adjacent and outside the primary air curtains 180 to assist in forming a barrier or buffer between ambient air surrounding the case 15 and the product display area 35. As illustrated in FIG. 2, the primary air curtains 180 and the secondary air curtain 200 are directed generally downwardly across the front of the case 15 adjacent the product display area 35 to cool food product supported on the shelves 80. In some constructions, the secondary air curtain 200 may be warmer than the primary air curtains 180 and cooler than surrounding ambient air.

Figure 10:
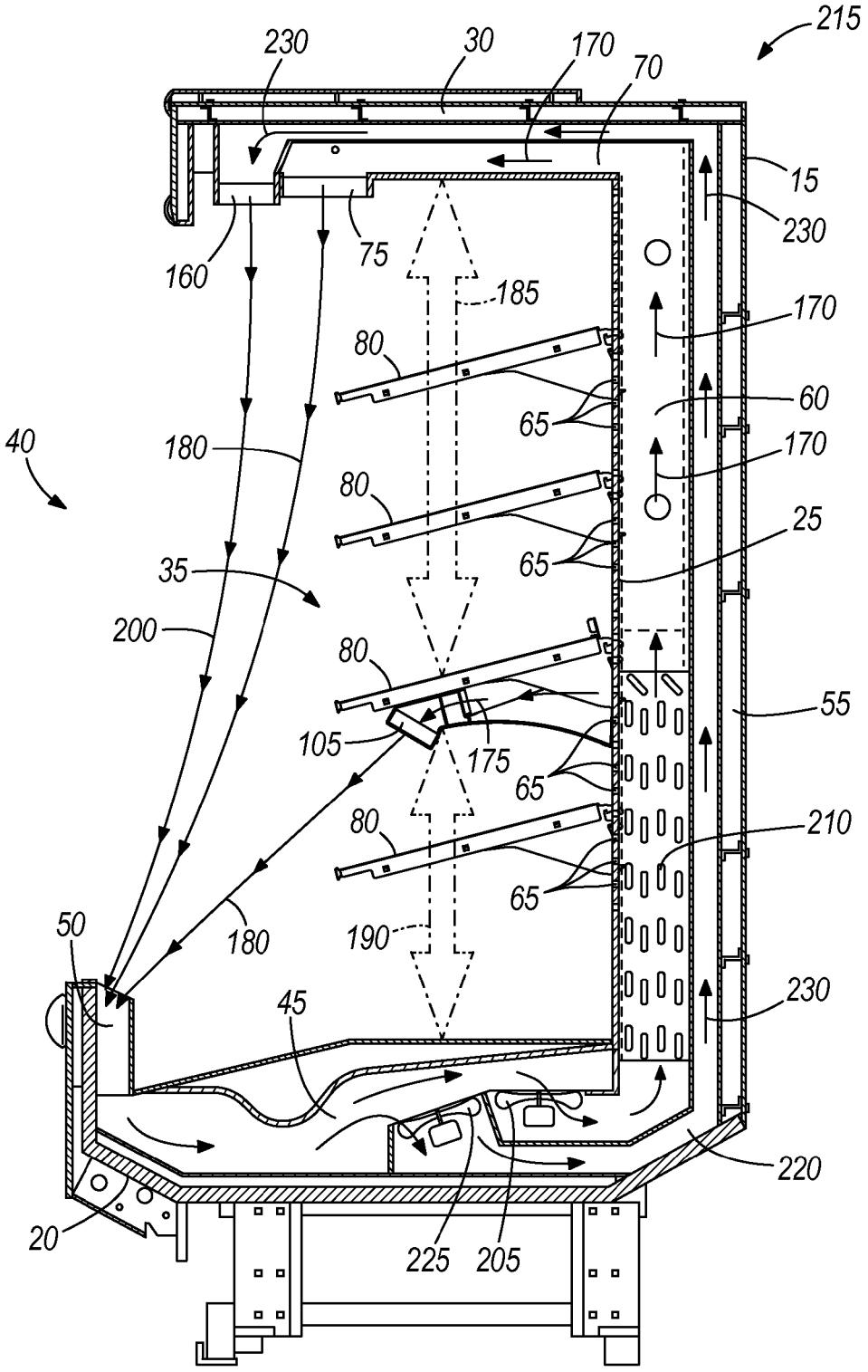
FIG. 10 a side view of another refrigerated merchandiser embodying the present invention.

In another construction, the secondary air curtain 200 can be formed by capturing cold air adjacent the air inlet 50 and circulating the captured air through the merchandiser 150 before discharging the circulated cold air through the secondary outlet 160. For example, FIG. 10 shows another construction of a refrigerated merchandiser 215 that may be located in a supermarket or a convenience store for presenting fresh food, beverages, and other food product to consumers. Except as described below, the refrigerated merchandiser 215 is the same as the merchandiser 150 described with regard to FIG. 2, and common elements have been given the same reference numerals.

The secondary outlet 160 is located outward from the primary outlet 75 adjacent an end of the canopy 30, and is in fluid communication with the air inlet 50 via a secondary air passageway 220. As illustrated, air from the air inlet 50 is drawn into the lower discharge flue 45 and is divided between the primary air passageway and the secondary air passageway 220 via respective air inlet portions in the base 20. With continued reference to FIG. 10, the air inlet portion of the primary air passageway has a substantially horizontal opening (relative to horizontal) and is located rearward of the air inlet portion of the secondary air passageway. The air inlet portion of the secondary air passageway has an angled opening (relative to horizontal). The primary air passageway directs the refrigerated airflows 170, 175 to the respective outlets 75, 140, and the secondary air passageway 220 directs a cool third airflow 230 from the air inlet 50 to the secondary outlet 160. The third airflow 230 discharged from the secondary outlet 160 defines the secondary air curtain 200. As illustrated, the secondary air curtain 200 is a long throw air curtain that travels generally downward from the secondary outlet 160 toward the air inlet 50. The secondary air curtain 200 is located adjacent and outside the primary air curtains 180 to assist in forming a barrier or buffer between ambient air surrounding the case 15 and the product display area 35. As illustrated in FIG. 10, the primary air curtains 180 and the secondary air curtain 200 are directed generally downwardly across the front of the case 15 adjacent the product display area 35 to cool food product supported on the shelves 80. In some constructions, the secondary air curtain 200 can be formed by capturing cold air from below the merchandiser 150, circulating the captured cold air through or around the merchandiser 150, and then discharging the circulated cold air through the secondary outlet 160.

Figure 11:
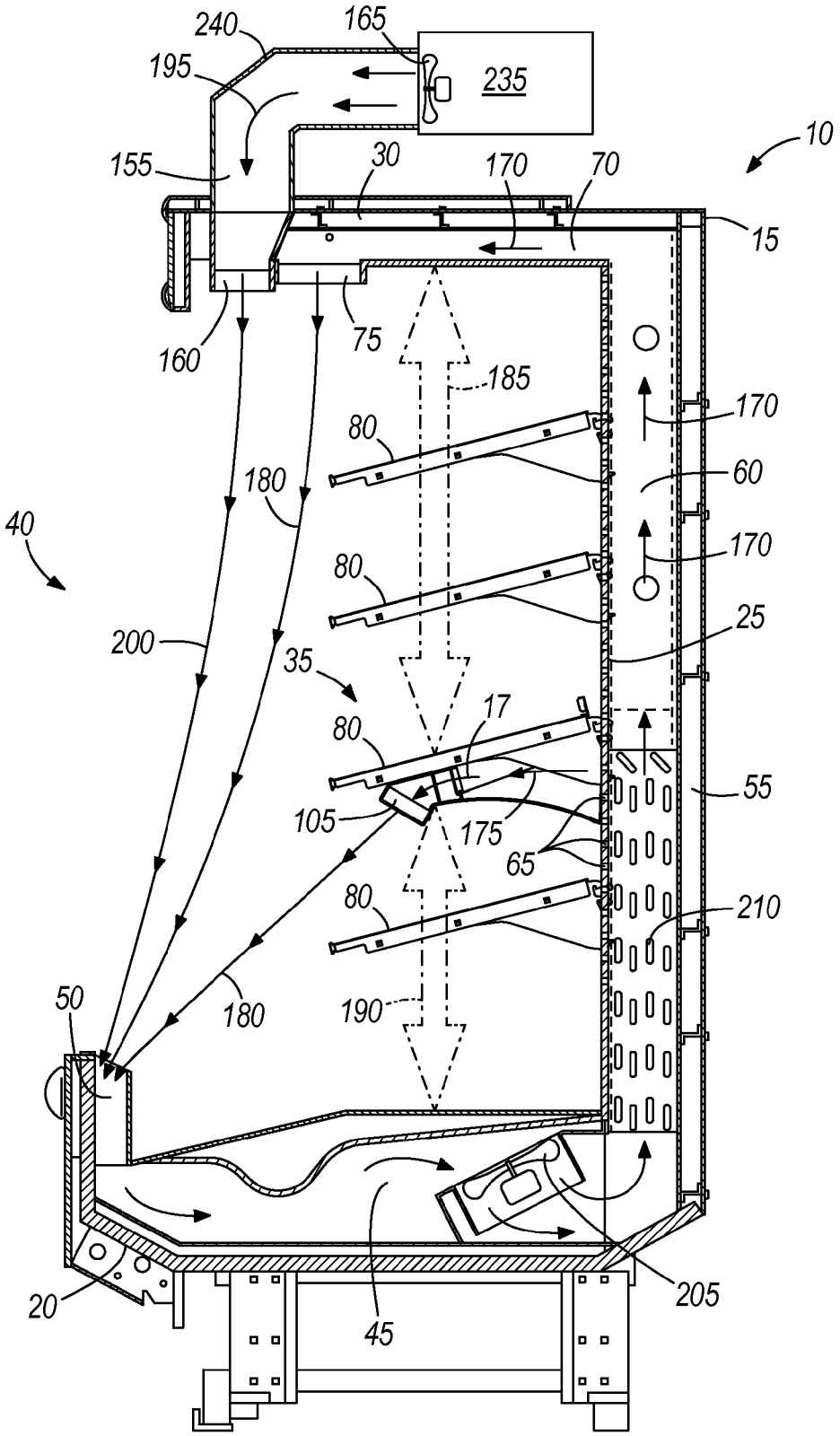
FIG. 11 a side view of another refrigerated merchandiser embodying the present invention.

In yet another construction, the secondary air curtain 200 can be formed by ducting cool air from a heating, ventilation, and air conditioning ("HVAC") system to the merchandiser 150 and then discharging the cool air through the secondary outlet 160. For example, FIG. 11 shows that the air passageway 155 can be in fluid communication with and directly connected to a HVAC system 235 by ducting 240 such that the air passageway 155 illustrated in FIG. 11 is a cool air passageway. The ducting 240 is connected to one or more air distribution ducts (not shown) located throughout the retail setting. The ducting 240 is coupled between the air passageway 155 of the refrigerated merchandiser 150 and the HVAC system 235 instead of fluidly connecting the air passageway 155 to the ambient environment surrounding the case 15. In some constructions, a baffle (not shown) can be located in or near the ducting 240 to selectively control the airflow through the ducting 240. In the illustrated construction, the fan 165 is a blower of the HVAC system 235 that is in direct fluid communication with the air passageway 155 to generate a cooled third airflow 195. In some constructions, the fan 165 can be located in other areas of the HVAC system 235 (e.g., in the ducting 240).

With continued reference to FIG. 11, the first airflow 170 discharged from the primary outlet 75 and the second airflow 175 discharged from the discharge outlet 140 define primary respective long throw and short throw air curtains 180 that form sequential air curtains directed across the upper interior portion 185 and the lower interior portion 190 of the merchandiser 150 to cool the upper and lower interior portions 185, 190 within the desired temperature range.

With continued reference to the merchandiser 150 illustrated in FIG. 11, the cool air passageway 155 directs the third airflow 195 from the HVAC system 235 through the ducting 240 (e.g., generally downward) to the secondary outlet 160. The third airflow 195 discharged from the secondary outlet 160 defines the secondary air curtain 200, which defines a sequential air curtain with the air curtains 180 and assists in forming a barrier or buffer between ambient air surrounding the case 15 and the product display area 35. As illustrated in FIG. 11, the primary air curtains 180 and the secondary air curtain 200 are directed generally downwardly across the front of the case 15 adjacent the product display area 35 to cool food product supported on the shelves 80.

The primary and secondary air curtains 180, 200 cooperatively define parallel airflows that reduce the amount of ambient air infiltration into the respective merchandisers 10, 150 and that maintain a relatively small range of food product temperatures throughout the product display area 35. The sequential air curtains 180, among other things, help to maintain the air temperature in the product display area 35 within a standard temperature range. For example, for medium temperature cases the temperature range is 32 to 41 degrees Fahrenheit as determined by the Food and Drug Administration ("FDA") Food Code.

With reference to FIGS. 1, 2, and 10, the refrigerated merchandisers 10, 150 also include some components of a refrigeration system (not entirely shown) therein. As shown in FIGS. 1 and 2, one or more fans 205 can be located in the primary air passageway (e.g., adjacent the air inlet portion of the primary air passageway) to generate the airflows 170, 175 by drawing air into the primary air passageway from the air inlet 50 and forcing the air through the flues 45, 60, 70. As shown in FIG. 10, one or more fans 225 can be coupled to the case 15 in the secondary air passageway 220 (e.g., adjacent the air inlet portion of the secondary air passageway) to generate the third airflow 195 by drawing air into the secondary air passageway 220 from the air inlet 50 and forcing the airflow 195 through the case 15 toward the secondary outlet 160. The fans 205, 225 can be controlled so that desired amounts of air enter the primary air passageway and the secondary air passageway 220 (e.g., the speed of the fans 225 can be slower than the speed of the fans 205). With reference to FIGS. 1, 2, and 10, an evaporator 210 is disposed in the primary air passageway to refrigerate the airflows 170, 175. As is known in the art, the evaporator 210 evaporates saturated refrigerant as it passes through the evaporator 210 as a result of absorbing heat from the airflow passing over the evaporator 210. The absorption of heat by the refrigerant allows the temperature of the airflow to decrease as it passes over the evaporator 210.

The discharge duct apparatus 105 can be retrofit into an existing merchandiser, or alternatively, the discharge duct apparatus 105 can be attached to the shelf 80 before or when the shelf 80 is attached to the merchandiser 10, 150. The discharge duct apparatus 105 is mounted to the underside of the shelf 80 via attachment of the track 110 to the rail 95 while allowing the shelf 80 to be mounted at different angles relative to horizontal and at different vertical locations within the case 15. Also, the modular discharge duct apparatus 105 can be removed from the shelf 80 to provide access to the shelf 80 and the discharge duct apparatus 105 for service or cleaning without removal of the shelf 80 or other components from the case 15, and without removing food product from the shelf 80.

The discharge duct apparatus 105 provides the additional primary air curtain 180 by channeling refrigerated air from the rear discharge flue 60 (e.g., via the apertures 65) toward the front of the shelf 80 to maintain colder product temperatures in the lower interior portion 190 of the merchandiser 10, 150 and to reduce infiltration of ambient air into the product display area 35. The angle of discharge for the airflow 175 from the discharge duct apparatus 105 is determined by the orientation of the air discharge portion relative to horizontal. The primary air curtain 180 defined by the airflow 175 can be directed generally downward toward the air inlet 50 at any desired angle to cool food product below the discharge duct apparatus 105 and to supplement the primary air curtain 180 from the primary outlet 75.

With continued reference to FIGS. 1, 2, and 10, the dual primary air curtains 180 maintain food product supported in the upper interior portion 185 and in the lower interior portion 190 approximately within the same temperature range. The single primary air curtain 180 discharged from the primary outlet 75 provides a refrigerated airflow that maintains the upper interior portion 185 within a desired temperature range. As the primary air curtain 180 discharged from the primary outlet 75 travels farther away from the primary outlet 75, the refrigerated airflow warms up due to heat absorbed from the surroundings. The primary air curtain 180 discharged from the discharge outlet 140 provides another refrigerated airflow that complements the primary air curtain 180 from the primary outlet 75 to maintain the lower interior portion 190 within the desired temperature range by offsetting the increase in temperature of the long throw primary air curtain 180.

With reference to FIGS. 2 and 10, the dual air curtain provided by the primary air curtain 180 discharged from the primary outlet 75 and the secondary air curtain 200 adjacent the upper interior portion 185 limit infiltration of ambient air into the upper interior portion 185. The triple air curtain provided by the primary air curtains 180 and the secondary air curtain 200 adjacent the lower interior portion 190 limit infiltration of ambient air into the lower interior portion 190, thereby helping to maintain the lower interior portion 190 within the desired temperature range. The primary air curtains 180 and the secondary air curtain 200 reduce infiltration of ambient air into the product display area 35 by maintaining a robust refrigerated air curtain along the entire height of the opening 40, thereby reducing energy consumption of the merchandisers 10, 150 relative to energy consumed by existing merchandisers including a single, long-throw air curtain. The air curtains 180, 200 also provide more control over the temperature of the product display area 35 to extend the shelf life of food product supported on the shelves 80.

Various features and advantages of the invention are set forth in the following claims.

The invention claimed is:

1. A refrigerated merchandiser comprising:

a case defining a product display area having a customer access opening, the case including an air inlet;

a canopy disposed substantially above the product display area, the canopy including a first air outlet and a second air outlet located adjacent the first air outlet, the first air outlet and the second air outlet in communication with the product display area;

a shelf coupled to the case within the product display area for supporting food product;

a first passageway fluidly connecting the air inlet with the first air outlet to direct a first airflow through the first air outlet across at least a portion of the customer access opening, the first airflow discharged from the first air outlet defining a primary air curtain; and a second passageway in fluid communication with a HVAC system by ducting connected to one or more distribution ducts of a retail setting, the ducting coupled between the merchandiser and the HVAC system to direct a second airflow from the HVAC system through the second air outlet across at least a portion of the customer access opening, the second airflow discharged from the second air outlet defining a secondary air curtain, the primary and secondary air curtains cooperating with each other to minimize infiltration of ambient air into the product display area, wherein the first airflow is defined by a refrigerated airflow and the second airflow is warmer than the first airflow.

2. The refrigerated merchandiser of claim 1, wherein the second passageway is wholly located within the canopy to direct cool air from the HVAC system toward the second air outlet.

3. The refrigerated merchandiser of claim 1, wherein the shelf includes a third air outlet, the refrigerated merchandiser further comprising a third passageway in fluid communication with the third air outlet to direct a third airflow through the third air outlet downward across a portion of the customer access opening, the third airflow discharged from the third air outlet defining a primary short throw air curtain.

4. The refrigerated merchandiser of claim 3, wherein the third passageway is disposed below the shelf.

5. The refrigerated merchandiser of claim 3, wherein the third passageway is partially defined by the first passageway.

6. The refrigerated merchandiser of claim 5, further comprising a first fan in communication with the first passageway to force air through the first air outlet and the third air outlet, and a second fan located in the HVAC system and in direct fluid communication with the second passageway to generate the second airflow.

7. The refrigerated merchandiser of claim 6, wherein the upper portion of the product display area and the lower portion of the product display area are maintained at substantially the same temperature.

8. The refrigerated merchandiser of claim 3, wherein the primary air curtain and the secondary air curtain cooperate with each other to define a first sequential air curtain for maintaining an upper portion of the product display area within a predetermined temperature range, and wherein the primary air curtain, the primary short throw air curtain, and the secondary air curtain cooperate with each other to define a second sequential air curtain for maintaining a lower portion of the product display area within the predetermined temperature range.

9. The refrigerated merchandiser of claim 1, further comprising at least a portion of a refrigeration system including an evaporator coil disposed in the first passageway, wherein the first airflow in the first passageway is refrigerated by the evaporator coil and the second airflow is conditioned by the HVAC system.

10. A refrigerated merchandiser comprising:

a case defining a product display area having a customer access opening, the case including a base having an air inlet;

a canopy disposed substantially above the product display area, the canopy including a first air outlet and a second air outlet located adjacent the first air outlet, the first air outlet and the second air outlet in communication with the product display area;

a first passageway fluidly connecting the air inlet with the first air outlet to direct a first airflow through the first air outlet across at least a portion of the customer access opening, the first airflow discharged from the first air outlet defining a primary long throw air curtain;

a second passageway fluidly connecting a HVAC system with the second air outlet by ducting connected to one or more distribution ducts of a retail setting, the ducting coupled between the merchandiser and the HVAC system to direct a second airflow ducted from the HVAC system to the merchandiser through the second air outlet across at least a portion of the customer access opening, the second airflow discharged from the second air outlet defining a secondary long throw air curtain, the primary long throw air curtain and the secondary long throw air curtain cooperating with each other to maintain an upper portion of the product display area within a predetermined temperature range;

a shelf coupled to the case within the product display area and including a third air outlet in communication with the product display area; and a third passageway in fluid communication with the third air outlet to direct a third airflow through the third air outlet across a portion of the customer access opening, the third airflow discharged from the third air outlet defining a primary short throw air curtain located inside the primary long throw air curtain, the primary long throw air curtain, the secondary long throw air curtain, and the primary short throw air curtain cooperating with each other to maintain a lower portion of the product display area within the predetermined temperature range, wherein the first airflow is defined by a refrigerated airflow and the second airflow is warmer than the first airflow.

11. The refrigerated merchandiser of claim 10, wherein the third airflow is defined by a refrigerated airflow, and wherein the second airflow is warmer than the third airflow.

12. The refrigerated merchandiser of claim 11, wherein the third passageway is in fluid communication with the air inlet, and wherein the third passageway is partially defined by the first passageway.

13. The refrigerated merchandiser of claim 12, further comprising a first fan in communication with the first passageway to force air through the first air outlet and the third air outlet, and a second fan located in the HVAC system and in direct fluid communication with the second passageway to generate the second airflow.

14. The refrigerated merchandiser of claim 11, further comprising at least a portion of a refrigeration system including an evaporator coil disposed in the first passageway, wherein the first airflow in the first passageway is refrigerated by the evaporator coil and the second airflow is conditioned by the HVAC system.

15. The refrigerated merchandiser of claim 10, wherein the third passageway is disposed below the shelf.

16. The refrigerated merchandiser of claim 10, wherein the primary long throw air curtain and the secondary long throw air curtain cooperate to define a first sequential air curtain adjacent the upper portion of the product display area, and wherein the primary long throw air curtain, the secondary long throw air curtain, and the primary short throw air curtain cooperate to define a second sequential air curtain adjacent the lower portion of the product display area such that the upper portion of the product display area and lower portion of the product display area are maintained at substantially the same temperature.

17. A refrigerated merchandiser comprising:

a case defining a product display area having a customer access opening, the case including a base having an air inlet;

a canopy disposed substantially above the product display area, the canopy including a first air outlet and a second air outlet located adjacent the first air outlet, the first air outlet and the second air outlet in communication with the product display area;

a shelf coupled to the case within the product display area for supporting food product;

a first passageway fluidly connecting the air inlet with the first air outlet to direct a first refrigerated airflow through the first air outlet across at least a portion of the customer access opening, the first refrigerated airflow discharged from the first air outlet defining a primary air curtain;

a second passageway fluidly connecting a HVAC system with the second air outlet by ducting connected to one or more distribution ducts of a retail setting, the ducting coupled between the merchandiser and the HVAC system to direct a second airflow through the second air outlet across at least a portion of the customer access opening, the second airflow discharged from the second air outlet defining a secondary air curtain;

a first fan coupled to the case and in fluid communication with the first passageway to generate the first refrigerated airflow; and a second fan located in the HVAC system and in direct fluid communication with the second passageway to generate the second airflow, wherein the second airflow is warmer than the first refrigerated airflow.

18. The refrigerated merchandiser of claim 17, wherein the second passageway is wholly located within the canopy to direct cool air from the HVAC system toward the second air outlet.

19. The refrigerated merchandiser of claim 17, wherein the shelf includes a third air outlet in communication with the product display area, the refrigerated merchandiser further comprising a third passageway disposed below the shelf and in fluid communication with the air inlet to direct a third refrigerated airflow through the third air outlet across a portion of the customer access opening inside the primary air curtain.

20. The refrigerated merchandiser of claim 19, wherein the first refrigerated airflow, the second airflow, and the third refrigerated airflow cooperate to maintain an upper portion of the product display area and a lower portion of the product display area at substantially the same temperature.

21. The refrigerated merchandiser of claim 17, wherein the second airflow is ducted downward from the HVAC system to the merchandiser.

22. The refrigerated merchandiser of claim 17, further comprising at least a portion of a refrigeration system including an evaporator coil disposed in the first passageway, wherein the first airflow in the first passageway is refrigerated by the evaporator coil and the second airflow is conditioned by the HVAC system.

* * * * *